US007655190B2

(12) United States Patent
Satou et al.

(10) Patent No.: US 7,655,190 B2
(45) Date of Patent: Feb. 2, 2010

(54) BIOCHEMICAL REACTION APPARATUS AND BIOCHEMICAL REACTION METHOD

(75) Inventors: Saya Satou, Musashino (JP); Takeo Tanaami, Musahino (JP)

(73) Assignee: Yokogawa Electric Corporation, Tokyo (JP)

( * ) Notice: Subject to any disclaimer, the term of this patent is extended or adjusted under 35 U.S.C. 154(b) by 352 days.

(21) Appl. No.: 11/832,297

(22) Filed: Aug. 1, 2007

(65) Prior Publication Data

US 2008/0038164 A1 Feb. 14, 2008

(30) Foreign Application Priority Data

Aug. 3, 2006 (JP) ..... 2006-212202

(51) Int. Cl.
*B01L 3/00* (2006.01)

(52) U.S. Cl. ..... 422/102; 422/100

(58) Field of Classification Search ..... 422/102, 422/100, 99, 103, 104

See application file for complete search history.

(56) References Cited

U.S. PATENT DOCUMENTS

2003/0143754 A1* 7/2003 Lum et al. ..... 436/180

FOREIGN PATENT DOCUMENTS

JP 2005-37368 A 2/2005

* cited by examiner

*Primary Examiner*—Jill Warden
*Assistant Examiner*—Natalia Levkovich
(74) *Attorney, Agent, or Firm*—Sughrue Mion, PLLC

(57) ABSTRACT

A biochemical reaction apparatus used to carry out a chemical reaction of fluid includes a cartridge including a container which is at least partially structured with an elastic body, the container including inside thereof a plurality of chambers to contain the fluid and flow passages to connect the plurality of chambers and rollers to apply an external force to the elastic body and deform the elastic body to move the fluid in the flow passages or the chambers by rotationally moving on a front surface of the elastic body while the roller contacts with the front surface of the elastic body, and in a cross-sectional shape of the roller, which is perpendicular to a roller shaft, at least not less than three corners are included, and the cross-sectional shape is a shape in which sides between the corners are equal in length.

5 Claims, 7 Drawing Sheets

BIOCHEMICAL REACTION APPARATUS AND BIOCHEMICAL REACTION METHOD

BACKGROUND OF THE INVENTION

1. Field of the Invention

The present invention relates to a biochemical reaction apparatus which is capable of easily carrying out a synthesis, dissolution, detection, a separation or the like of a solution according to a determined protocol without individual differences at low price and a biochemical reaction method.

2. Description of the Related Art

Conventionally, a test tube, a beaker, a pipette and the like are generally used for processes such as a synthesis, dissolution, detection, a separation or the like of a solution. For example, a substance A and a substance B are collected in the test tubes or the beakers in advance, these substances are injected into the other container which is a test tube or a beaker, and a substance C is prepared by mixing/agitating the mixture of substances A and B. Concerning the substance C synthesized in such way, for example, a light emission, a heat generation, coloration, a colorimetry and the like are observed. Alternatively, in some cases, filtration, a centrifugal separation, or the like is carried out for the mixed substance, and a targeted substance is separated and extracted.

Moreover, glassware such as a test tube, a beaker or the like is also used in a dissolution process which is a process of dissolving a substance by an organic solvent, for example. Similarly in case of a detection process, a test substance and a reagent are introduced in a container and the reaction result is observed.

As a chemical reaction cartridge used for such purpose, there is known a cartridge in which a plurality of chambers recessed in a front surface side and flow passages which connects the plurality of chambers to one another are formed on a back surface of the elastic body, and in which a substrate is provided on the back surface of the elastic body so as to hermetically seal the chambers and the flow passage (for example, see JP2005-037368A). Concerning the above chemical reaction cartridge, solutions such as a sample and a reagent are injected inside the chambers in advance, the flow passage, the reaction chamber, or both thereof are partially deformed by pressing a roller from the front surface side of the elastic body, and the solutions in the flow passage or the reaction chambers move. In such way, the solutions are mixed or the reagent is added to a solution.

The roller used in the above chemical reaction cartridge has a circular cross-sectional shape. Therefore, there is a possibility that the reaction chambers which are composed of elastic bodies are excessively pressurized, or that a solution residual or a backflow occurs due to not being able to surely move the solutions inside the reaction chambers because of insufficiency of the pressurization.

SUMMARY OF THE INVENTION

In view of the above problem, an object of the present invention is to provide a biochemical reaction apparatus which can resolve the solution residual and the backflow and can surely transfer the solution, and a biochemical reaction method.

In accordance with a first aspect of the present invention, a biochemical reaction apparatus to carry out a chemical reaction of fluid comprises a cartridge including a container which is at least partially structured with an elastic body, the container including inside thereof a plurality of chambers to contain the fluid and flow passages to connect the plurality of chambers and rollers to apply an external force to the elastic body and deform the elastic body to move the fluid in the flow passage or the chambers by rotationally moving on a front surface of the elastic body while the rollers contact with the front surface of the elastic body, and in a cross-sectional shape of the roller, which is perpendicular to a roller shaft, at least not less than three corners are included, and the cross-sectional shape is a shape in which sides between the corners are equal in length.

Preferably, the cross-sectional shape of the roller is a square.

Preferably, the cross-sectional shape of the roller is a Reureaux polygonal.

Preferably, the plurality of chambers are equal in length in a direction of the roller movement, and are equal in length to a length of each side of the roller, and an interval between the chambers which are adjacent to one another in the moving direction is an integral multiple of the length of each side of the roller.

Preferably, a plurality of rollers are provided so as to arrange each roller shaft along a direction perpendicular to the moving direction of each roller, and one roller among the plurality of rollers and one chamber among the plurality of chambers which are pressed by the one roller are equal in length in the direction perpendicular to the moving direction, and are arranged in parallel to one another with respect to the moving direction.

In accordance with a second aspect of the present invention, a biochemical reaction method to carry out a chemical reaction of fluid by using a cartridge including a container which is at least partially structured with an elastic body, the container including inside thereof a plurality of chambers to contain the fluid and a flow passage to connect the plurality of chambers comprises applying an external force to the elastic body and deforming the elastic body to move the fluid in the flow passage or the chambers by rotationally moving a roller on a front surface of the elastic body while the roller contacts with the front surface of the elastic body, and in a cross-sectional shape of the roller, which is perpendicular to a roller shaft, at least not less than three corners are included, and the cross-sectional shape is a shape in which sides between the corners are equal in length.

According to the present invention, the surface area between the corners of the roller contacts the front surface of the elastic body as a surface and squeezes the elastic body, and the corner of the roller can rigidly press the elastic body due to the roller rotationally moving on the front surface of the elastic body while contacting thereto. Accordingly, the solution can be surly transferred without an occurrence of the solution residual or the twisting of the elastic body. Further, the stress concentrates at the corner in a state where the corner of the roller is contacting the front surface of the elastic body. Therefore, the elastic body can be rigidly sealed and the backflow of the solution can be prevented.

BRIEF DESCRIPTION OF THE DRAWINGS

The present invention will be fully understood from the detailed description given hereinafter and the accompanying drawings given by way of illustration only, and thus are not intended as a definition of the limits of the present invention, wherein.

PREFERRED EMBODIMENT OF THE INVENTION

Hereinafter, the first and the second embodiments of the present invention will be described.

First Embodiment

Figure 1A:
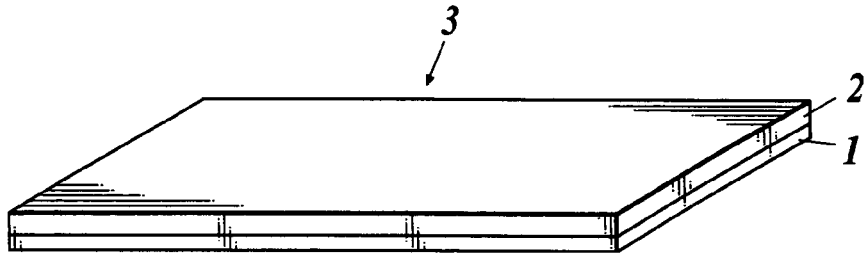
FIG. 1A is a perspective view of a cartridge 3.
Figure 1B:
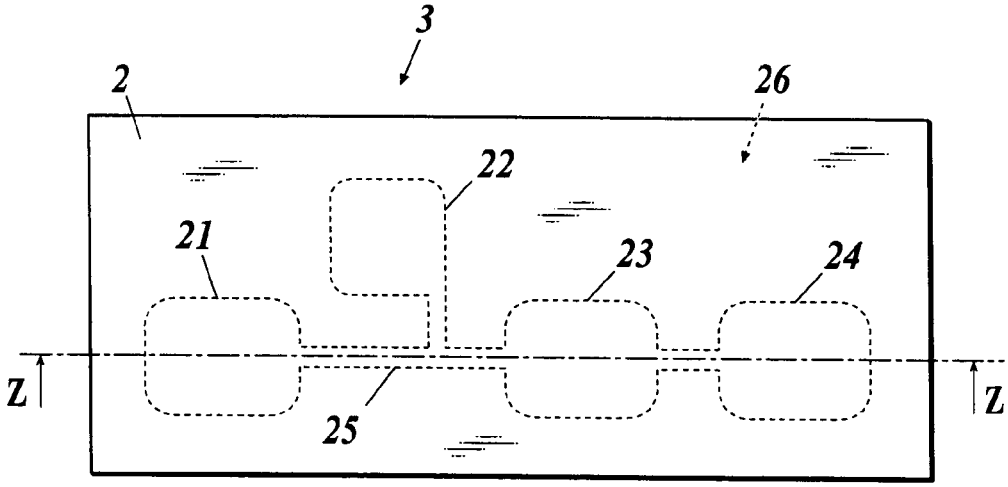
FIG. 1B is a top view of the cartridge 3.
Figure 1C:
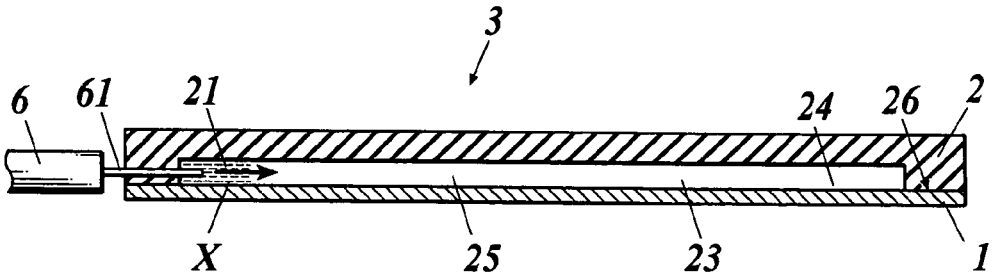
FIG. 1C is a cross-sectional view cut along the line Z-Z of FIG. 1B.
Figure 2:
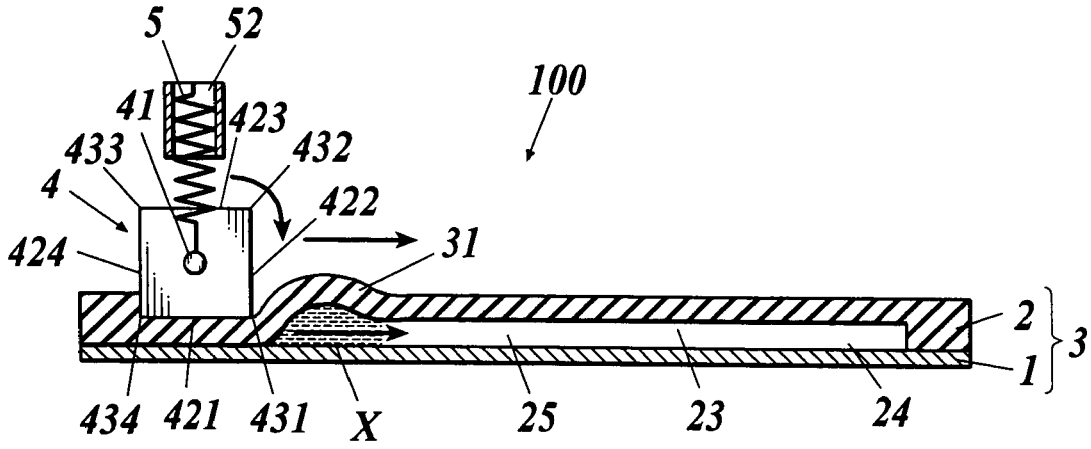
FIG. 2 shows a roller 4 in an operating state, and is a cross-sectional view cut along the line Z-Z of FIG. 1B.

FIG. 1A is a perspective view of a cartridge 3, FIG. 1B is a top view of the cartridge 3, FIG. 1C is a cross-sectional view cut along the line Z-Z of FIG. 1B, and FIG. 2 shows a roller 4 in an operating state and is a cross-sectional view cut along the line Z-Z of FIG. 1B.

In a biochemical reaction apparatus 100, an elastic body 2 is provided on a substrate 1 in a stacking manner, and the biochemical reaction apparatus 100 comprises the cartridge 3 and the roller 4. The cartridge 3 is composed by having a plurality of chambers 21 to 24 in which solutions (fluid) are contained and a flow passage 25 which connects the chambers 21 to 24 formed between the substrate 1 and the elastic body 2. The roller 4 applies an external force to the elastic body 2 and partially deforms the flow passage 25, the chambers 21 to 24, or both thereof, and the solutions in the flow passage 25 or the chambers 21 to 24 are moved by the roller 4 moving on an upper surface of the elastic body 2 while contacting thereto. A container comprises the substrate 1 and the elastic body 2.

The substrate 1 is formed with a hard material, and is in a long plate shape for determining a position and maintaining the shape.

The elastic body 2 is formed with a material in which at least a portion thereof includes an elastic body such as rubber having airtightness and elasticity, and is in a long plate shape in a same size as the substrate 1. A viscoelastic body or a plastic body may be used for the elastic body 2 besides rubber. A plurality of chambers for solutions (hereinafter, referred to as chambers 21 and 22) which are respectively recessed in an upper surface side, a chamber for reaction (hereinafter, referred to as a reaction chamber 23), a chamber for containing a waste fluid (hereinafter, referred to as a waste fluid containing chamber 24), and the flow passage 25 which is connected to the chambers 21 and 22, the reaction chamber 23, and the waste fluid containing chamber 24, respectively, are formed on a lower surface of the elastic body 2 which is the contacting surface with the substrate 1. The chambers 21 and 22, the reaction chamber 23, and the waste fluid containing chamber 24 are all formed in a rectangular shape in plan view having rounded four corners. Further, the reactant solution in the reaction chamber 23 is extractable (can be vacuumed) from the elastic body 2 side by a syringe or the like.

Further, the adhered area 26 of the lower surface of the elastic body 2 which excludes the chambers 21 and 22, the reaction chamber 23, the waste fluid containing chamber 24, and the flow passage 25 is adhered to the upper surface of the substrate 1. Accordingly, the chambers 21 and 22, the reaction chamber 23, the waste fluid containing chamber 24, and the flow passage 25 are hermetically sealed by the elastic body 2 and the substrate 1. Thereby, leakage of the solution X is prevented.

The roller 4 is shaped in a quadratic prism in which the cross-sectional shape when cut in a direction perpendicular to the roller shaft 41 is in a square shape (four sides are equal in length) having four corners 431 to 434. The roller shaft 41 is positioned in the cross-sectional center of gravity of the roller 4. The roller 4 can move freely in a longitudinal direction of the elastic body 2 on the upper surface thereof, and four sides 421 to 424 of the roller 4 which are parallel in the direction of the roller shaft 41 are to contact the upper surface of the elastic body 2. A rail unit 51 (see FIG. 3) which supports the roller 4 on the upper surface of the elastic body 2 so as to move freely is provided above the roller 4 by being extended in the longitudinal direction of the cartridge 3. A guiding unit 52 which can move freely along the rail unit 51 is provided on the rail unit 51, an upper end of a spring 5 which is retractable in an up-down direction is fixed to the guiding member 52, and the roller shaft 41 of the roller 4 is fixed to a lower end of the spring 5. In such way, flexibility in the up-down direction is given to the roller shaft 41 by the spring 5. Further, the roller 4 can rotationally move on the upper surface of the elastic body 2 while contacting thereto under consistent pressure along with moving of the guiding member 52 due to the guiding member 52 horizontally moving along the rail unit 51.

Figure 3A:
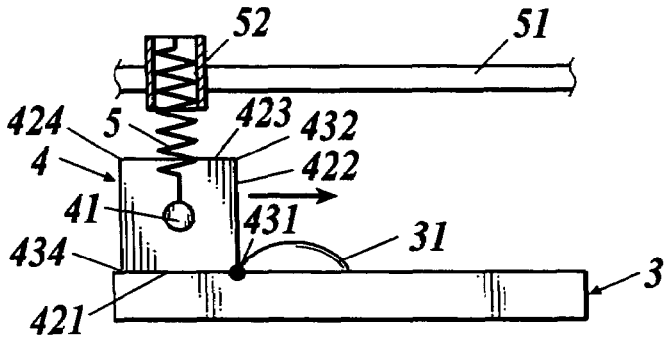
FIGS. 3A to 3D are side views schematically showing the roller 4 in an operating state.
Figure 3B:
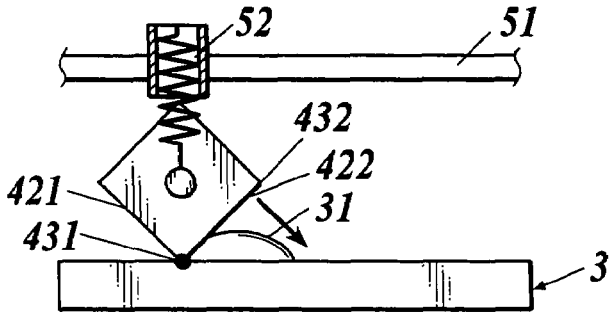

FIGS. 3A to 3D are side views schematically showing the roller 4 in an operating state. In FIG. 2 and FIG. 3, a reference numeral 31 expresses the state in which the upper surface of the elastic body 2 is bulged by the solution X in the chamber 21. In FIG. 3A, the roller 4 positions at the left end of the upper surface of the elastic body 2, and an entire surface of the side 421 which is one of the four sides 421 to 424 and the corners 431 and 434 of the roller 4 contact the upper surface of the elastic body 2 and squeeze the chamber 21 or a portion thereof. From this state, the roller 4 rotates centering on the corner 431 by moving the guiding unit 52 from the side of the rail unit 51 to the right side thereof. Here, as shown in FIG. 3B, the stress concentrates at the corner 431, and the upper surface of the elastic body 2 is pressurized due to contraction of the spring 5. As a result, the corner 431 functions as a check valve and the backflow of the solution X contained in the chamber 21 is prevented.

Figure 3C:
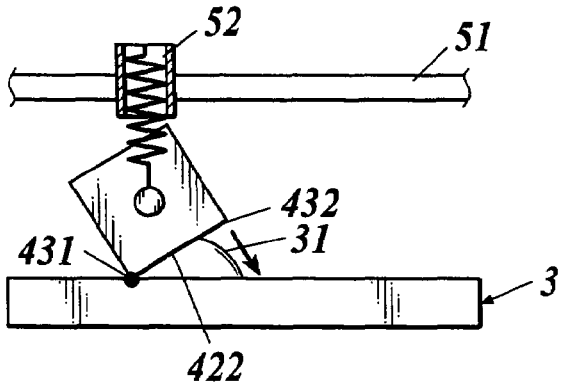
Figure 3D:
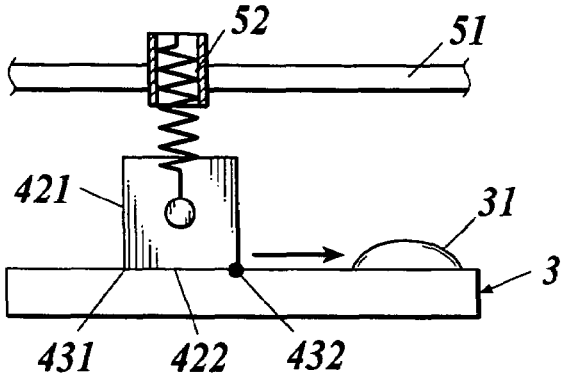

Moreover, the corner 432 contacts the upper surface of the elastic body 2 and the spring 5 elongates by the roller 4 rotating centering on the corner 431 (see FIG. 3C). Thereby, the upper surface of the elastic body 2 is pressed by the entire surface of the side surface 422 and the corners 431 and 432 of the roller 4, and the chamber 21 is squeezed (see FIG. 3D). In such way, the solution X contained in the chamber 21 is pushed out in the right direction by moving the roller 4 in the right direction.

Figure 4A:
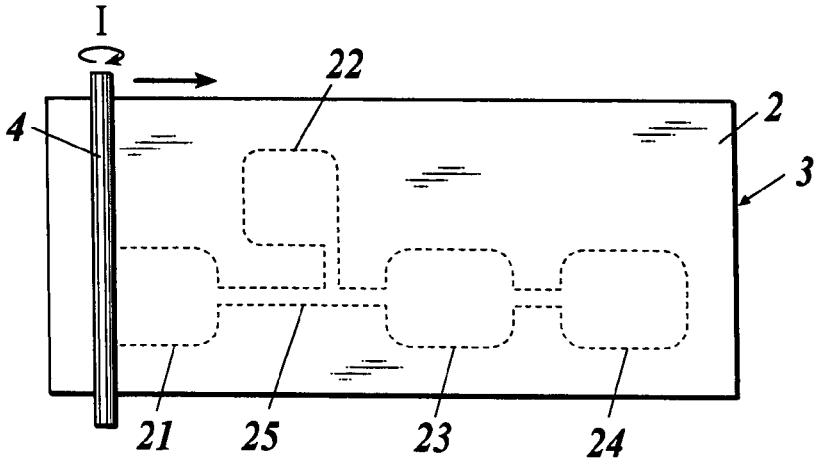
FIGS. 4A to 4C are top views schematically showing the roller 4 in an operating state.
Figure 4B:
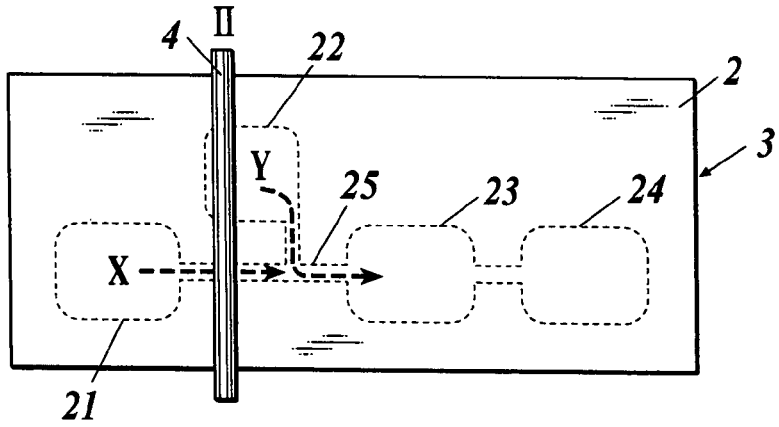
Figure 4C:
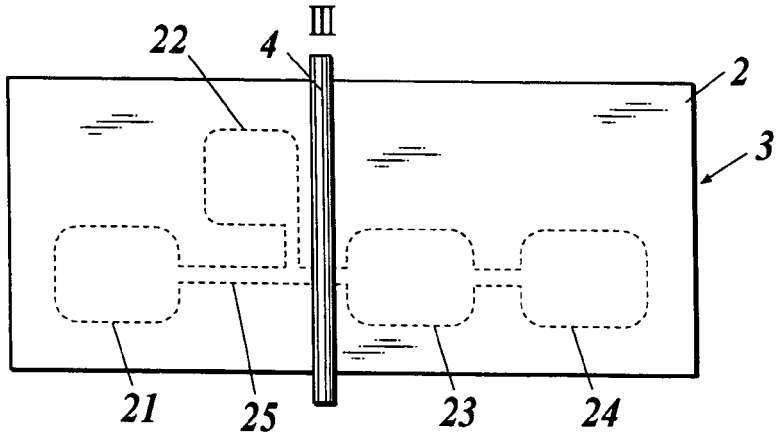

Next, an operation of the solution transfer in the cartridge 3 will be described. FIGS. 4A to 4C are top views schematically showing the roller 4 in an operating state.

First, the solution X and the solution Y are respectively injected in the chamber 21 and the chamber 22 formed in the cartridge 3 in advance. The injection is carried out by directly sticking a needle 61 to the elastic body 2 as shown in FIG. 1C, and the solutions are injected into the chamber 21 and the chamber 22 by the syringe 6. Because the elastic body 2 is formed with an elastic material, a hole made by the needle will close by itself when the needle 61 is pulled out. Here, in order to completely close and seal the hole, it is preferred to fill an adhesive agent in the hole or to seal by heating and dissolving the hole after the solutions are injected.

After the solutions X and Y are injected, the roller 4 shown in FIG. 4A is rotationally moved in the right direction from the position I by moving the guiding unit 52 along the rail unit 51 from the left to the right side thereof. In such way, the solution X contained in the chamber 21 is pushed out to the right direction. The solution X which is pushed out is transferred to the reaction chamber 23 through the flow passage 25. The air existed in the chamber 21 is transferred to the waste fluid containing chamber 24.

When the roller 4 is rotationally moved to the position II as shown in FIG. 4B, transfer of the solution Y in the chamber 22 starts, subsequently. The solution Y is pushed out to the reaction chamber 23 through the flow passage 25. At this time, the middle of the flow passage 25 is also squeezed by the corners 431 to 434 of the roller 4, and this squeezing operation functions as a check valve and the backflow of the solution Y to the chamber 21 is prevented. Further, an excess solution is discharged to the waste fluid containing chamber 24.

When the roller 4 moves to the position III as shown in FIG. 4C, the solution X and the solution Y enter the reaction chamber 23 and the solutions are mixed and reaction is carried out. Here, reaction means a mixing, a synthesis, dissolution, a separation, or the like.

Such a cartridge 3 can be made in small size, lightweight, and low price, and the protocol for processes such as a mixing, a synthesis, dissolution, a separation, detection, or the like of a substance in the sealed cartridge 3 can be carried out easily without individual difference.

Moreover, the cartridge 3 is a hermetic type and is disposable, and even a virus or a dangerous drug can be handled safely. For example, the processes (a series of processes such as neutralization, distillation, dispersion, mixing, non-color detection, or the like) according to detection of cyanogens existing in an industrial effluent, a milling effluent, and the river water in which the industrial effluent and the milling effluent flow in, the extraction of DNA and protein from a blood stream or the affected part of the body, or the like can be carried out safely and surely in the cartridge 3.

As described above, the cross-sectional shape of the roller 4 in the direction perpendicular to the roller shaft 41 is a square having four corners 431 to 434. Therefore, in a state where the side surface 421 which is one of the four side surfaces 421 to 424 of the roller 4 contacts with the upper surface of the elastic body 2, the entire surface of the side surface 421 surely contacts and presses the upper surface of the elastic body 2 and both corners 431 and 432 of the contacting side surface 421 can rigidly press the upper surface of the elastic body 2 comparing to the case where the circular roller is used, for example, by the roller 4 rotationally moving on the upper surface of the elastic body 2 while contacting thereto. In such way, the roller 4 presses the surface to the upper surface of the elastic body 2 and does not roll on the upper surface of the elastic body. Therefore, the elastic body 2 which comprises the chambers 21 and 22, the reaction chamber 23, and the waste fluid containing chamber 24 does not twist. Further, the solution residual due to the solution entering from the space made by the twisting does not occur. As a result, the solution can be surly transferred. In a state where the corner 431 contacts the upper surface of the elastic body 2 due to the rotation of the roller 4, the stress concentrates at the corner 431. Therefore, the elastic body 2 can be rigidly sealed and the backflow of the solution can be prevented.

Particularly, the cross-sectional shape of the roller 4 is in a square shape, and thereby, the side surface 421 contacts the upper surface of the elastic body 2 as a surface in a state where the side surface 421 which is one of the four surfaces is contacting the upper surface of the elastic body 2. Therefore, the roller 4 is positioned without being unsteady comparing to the circular roller. Even in this respect, it leads to the prevention of the backflow and to the assured solution transfer.

Second Embodiment

Figure 5A:
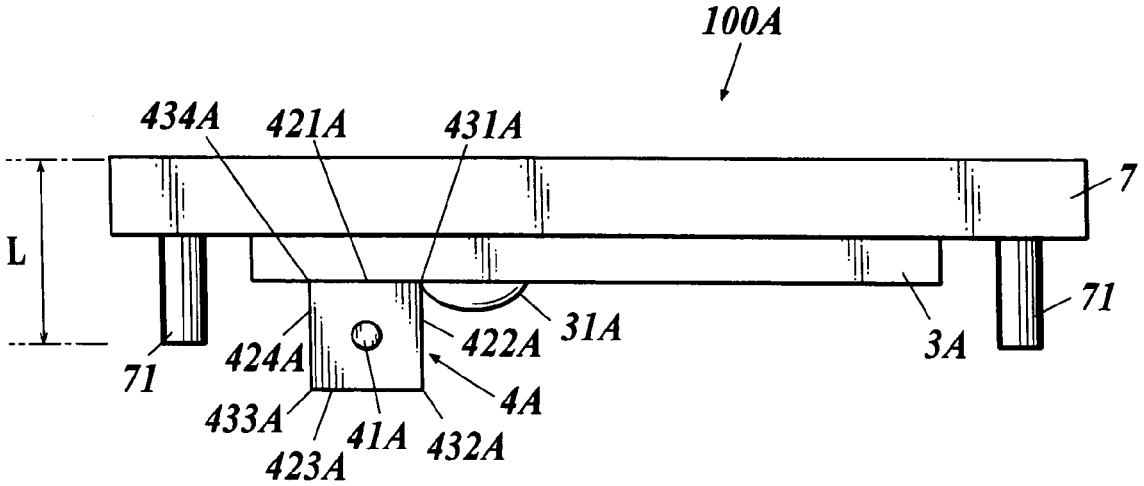
FIGS. 5A and 5B are diagrams schematically showing a roller 4A in an operating state.
Figure 5B:
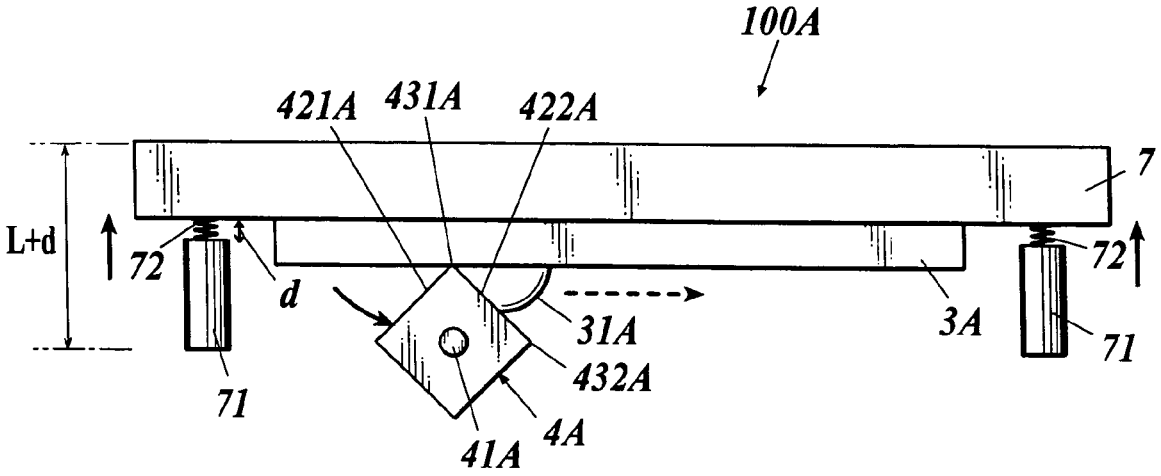

FIGS. 5A and 5B are diagrams schematically showing the roller 4A in an operating state. In FIGS. 5A and 5B, the reference numeral 31A expresses the state in which the upper surface of the elastic body 2A is bulged by the solution in the chamber.

Differently from the above-described first embodiment, the present embodiment describes a case in which flexibility in an up-down direction is given to the cartridge 3A side by the springs 72 and 72. Here, the cartridge 3A and the roller 4A are the same as the cartridge 3 and the roller 4 of the first embodiment. Therefore, the same components are indicated by the same numbers with an alphabet A, and the descriptions are omitted.

As shown in FIGS. 5A and 5B, the cartridge 3A is attached to a lower surface of a plate shaped supporting base 7, and supporting rods 71 and 71 which respectively extend downward and support the supporting base 7 are attached to both left and right ends of the lower surface of the supporting base 7 via the springs 72 and 72. In such way, flexibility in the up-down direction is given to the roller shaft 41A by the spring 72 and 72. The contracted state of the spring 72 as shown in FIG. 5A is the natural state for the spring 72. The roller 4A can rotationally move on a lower surface of the elastic body 2A while contacting thereto under consistent pressure by the supporting rods 71 and 71 expanding and contracting in the up-down direction along with the moving of the roller 4A.

The elastic body 2A is turned over on the down side and the cartridge 3A is fixed on the lower surface of the supporting base 7.

The roller 4A is shaped in a quadratic prism in which the cross-sectional shape when cut in a direction perpendicular to the roller shaft 41A is shaped in a square. The roller shaft 41A is positioned in the cross-sectional center of gravity of the roller 4A. The roller 4A can move freely in a longitudinal direction of the elastic body 2A on the lower surface thereof, and four side surfaces 421A to 424A of the roller 4A which are parallel in the direction of the roller shaft 41A are to contact the lower surface of the elastic body 2A.

In FIG. 5A, the roller 4A positions at a left end of the lower surface of the elastic body 2A, and the entire surface of the side surface 421A which is one of four side surfaces 421A to 424A and the corners 431A and 434A of the roller 4A contact the lower surface of the elastic body 2A and squeeze the chamber. From this state, the roller 4A rotates centering on the corner 431A by horizontally moving the roller shaft 41A of the roller 4A in the right direction. At this time, the stress concentrates at the corner 431A and the lower surface of the elastic body 2A is pressurized by the springs 72 and 72 extending for the length d as shown in FIG. 5B. As a result, the corner 431A functions as a check valve and the backflow of the solution contained in the chamber is prevented.

Moreover, the corner 432A contacts the lower surface of the elastic body 2A and the springs 72 and 72 contract by the roller 4A rotating centering on the corner 431A of the roller 4A. Thereby, the lower surface of the elastic body 2A is pressed by the entire surface of the side surface 42A and the corners 431A and 432A of the roller 4A, and the chamber is squeezed (omitted from the drawing). In such way, the solution contained in the chamber is pushed out in the right direction by rotationally moving the roller 4A in the right direction. The solution which is pushed out is transferred to the reaction chamber through the flow passage and then, each solution is mixed and reaction is carried out in a similar manner as the first embodiment.

Third Embodiment

Figure 6:
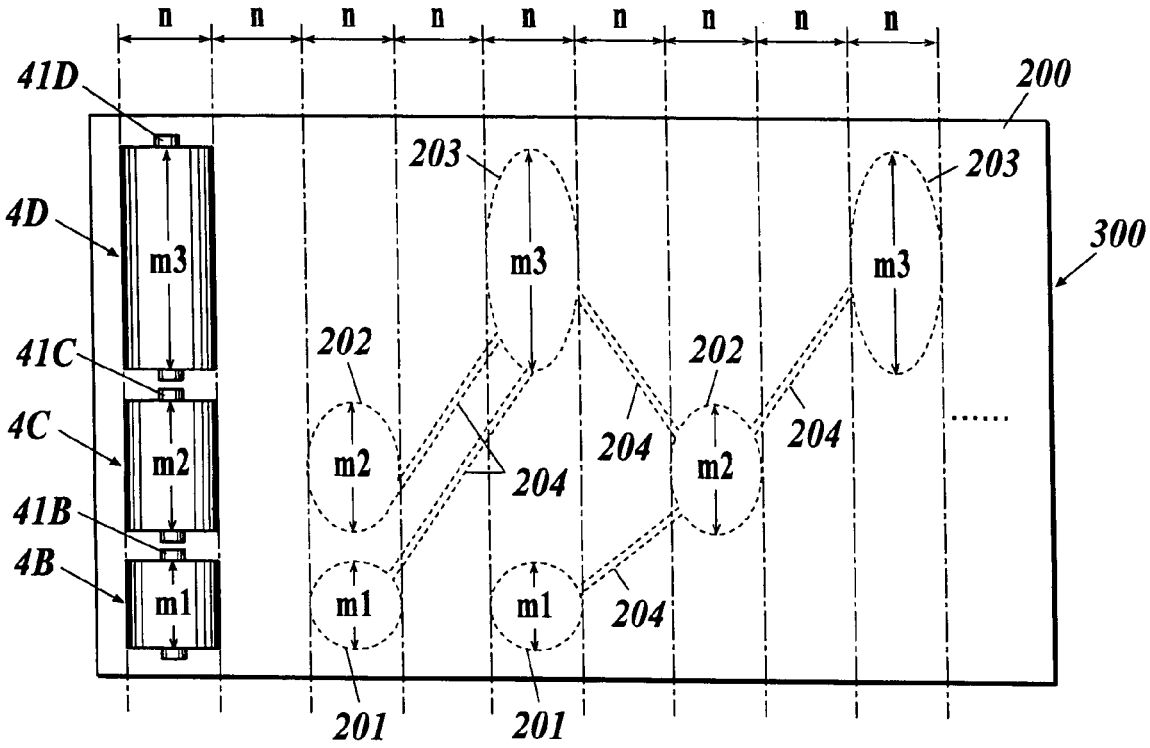
FIG. 6 is a top view showing a state where the first to third rollers 4B to 4D are positioned at a left end of an upper surface of an elastic body 200.

FIG. 6 is a top view showing a state where the first to third rollers 4B to 4D are positioned at a left end of an upper surface of an elastic body 200.

In the third embodiment, three rollers 4B to 4D in which lengths m1 to m3 in directions of roller shafts 41B to 41D are different are provided on a straight line so that the roller shafts 41B to 41D of each of the rollers 4B to 4D follow the short side direction (the direction perpendicular to the moving direction of the roller 4B) of the cartridge 30. Similarly to the rollers 4 and 4A of the above described first and second embodiment, the cross-sectional shapes of the first to third rollers 4B to 4D are in a square shape (length of each side is n). Further, each of the roller shafts 41B to 41D is positioned in the cross-sectional center of gravity of each of the roller 4B to 4D. Further, the elastic body 200 is squeezed and the solutions in each of the chambers 201 to 203 are to move to the next chambers 201 to 203 via the flow passage 204 by each of the rollers 4B to 4D rotationally moving along the longitudinal direction of the cartridge 300.

The cartridge 300 comprises a plurality of the first chambers 201 and 201 in a circular shape in plan view which is pressed by the first roller 41B having the shortest length, a plurality of the second chambers 202 and 202 in an oval shape in plan view which is pressed by the second roller 41C having the second shortest length, a plurality of the third chambers 203 and 203 in an oval shape in plan view which is pressed by the third roller 41D having the longest length, and a plurality of flow passages 204 and 204 which connect each of the chambers 201 to 203 to one another.

The first chambers 201 and 201 are disposed in a predetermined interval on a straight line along the longitudinal direction of the cartridge 300, and the second chambers 202 and 202 and the third chambers 203 and 203 are respectively disposed in a predetermined interval on a straight line along the longitudinal direction of the cartridge 300. The length m1 of the first chamber 201 in the short side direction of the cartridge 300 is equal to the length m1 of the first roller 4B. The length m2 of the second chamber 202 in the short side direction of the cartridge 300 is equal to the length m2 of the second roller 4C. The length m3 of the third chamber 203 in the short side direction of the cartridge 300 is equal to the length m3 of the third roller 4C. The lengths n of the first to third chambers 201 to 203 in the longitudinal direction of the cartridge 300 are all equal, and are equal to the length of one side of the square which is the cross-sectional shape of the first to third rollers 4B to 4D. Further, a space between the adjacent first chambers 201 and 201 is an integral multiple (times 1 in FIG. 6) of the length n which is the length of one side of the square of the first roller 4B. A space between the adjacent second chambers 202 and 202 is an integral multiple (times 1 or 3 in FIG. 6) of the length n which is the length of one side of the square of the second roller 4C. A space between the adjacent third chambers 203 and 203 is an integral multiple (times 3 in FIG. 6) of the length n which is the length of one side of the square of the third roller 4D.

Accordingly, first, the first roller 4B presses the first chamber 201 and at the same time, the second roller 4C presses the second chamber 202 by rotationally and simultaneously moving the first to the third rollers 4B to 4D in the right direction. Subsequently, the first roller 4B presses the next first chamber 201 and at the same time, the third roller 4D presses the third chamber 203, and each of the chambers 201 to 203 are orderly pressed by the rotational movement of the first to third rollers 4B to 4D and the solutions are pushed out to the flow passages 204 and 204. Here, the first to third chambers 201 to 203 are respectively in a same size as the first to third rollers 4B to 4D (the lengths in the longitudinal direction and the short side direction of the cartridge 300). Therefore, the first chamber 201 is to be squeezed by the entire surface of the side surface of the first roller 4B, the second chamber 202 is to be squeezed by the entire surface of the side surface of the second roller 4C, and the third chamber 203 is to be squeezed by the entire surface of the third roller 4D, simultaneously. As a result, the solution transfer is carried out surely without occurrence of the backflow and the solution residual.

Figure 7A:
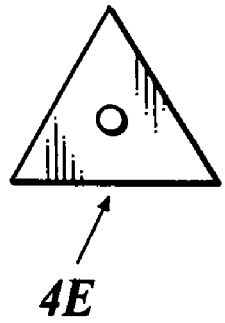
FIGS. 7A to 7D are side views of rollers 4E to 4H.
Figure 7B:
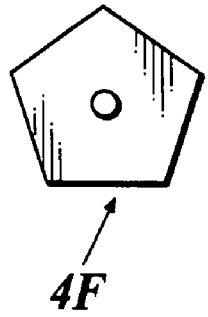
Figure 7C:
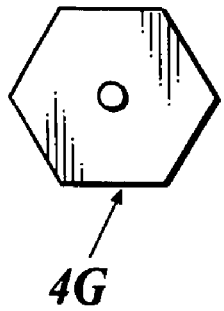
Figure 7D:
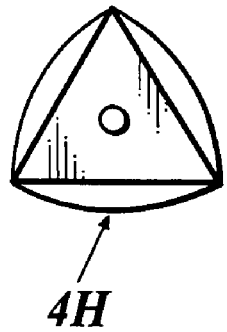

The present invention is not limited to the above described embodiments, and can be arbitrarily changed within the gist of the invention. For example, in the above first to third embodiments, the rollers 4, 4A, and 4B to 4D are formed in a quadratic prism having a square cross-sectional shape. However, it is not limited to this, and a roller 4E of FIG. 7A having an equilateral triangular cross-sectional shape, a roller 4F of FIG. 7B having an equilateral pentagonal cross-sectional shape, a roller 4G of FIG. 7C having an equilateral hexagonal cross-sectional shape, or a roller 4H of FIG. 7D having a Reuleaux polygonal cross-sectional shape may be used. Particularly, the more polygonal the cross-sectional shape is, the more preferable because the problem of shaft fluctuation is resolved since the roller moves like a roller having a circular cross-sectional shape. Among them, the Reuleaux polygon is preferable in a respect that the elastic body can be surely pressurized by the corner while the roller moving like a roller having a circular cross-sectional shape, and the backflow can be effectively prevented.

Moreover, the chambers 21 and 22, the reaction chamber 23, and the waste fluid containing chamber 24 are in a rectangular shape in a plan view having rounded four corners in the first and second embodiments, and in a circular and oval shape in the third embodiment. However, they are not limited to this, and they can be arbitrarily changed, and the number of chambers and the space between the chambers can also be changed.

The entire disclosures of Japanese Patent Application No. 2006-212202 filed on Aug. 3, 2006 including specification, claims, drawings and abstract thereof are incorporated herein by reference in its entirety.

What is claimed is:

1. A biochemical reaction apparatus to carry out a chemical reaction of fluid, comprising:

a cartridge including a container which is at least partially structured with an elastic body, the container including inside thereof a plurality of chambers to contain the fluid and flow passages to connect the plurality of chambers, and a roller to apply an external force to the elastic body and deform the elastic body to move the fluid in the flow passages or the chambers by rotationally moving on a front surface of the elastic body while the roller contacts with the front surface of the elastic body, wherein in a cross-sectional shape of the roller, which is perpendicular to a roller shaft, at least not less than three corners are included, and the cross-sectional shape is a shape in which sides between the corners are equal in length.

2. The biochemical reaction apparatus as claimed in claim 1, wherein the cross-sectional shape of the roller is a square.

3. The biochemical reaction apparatus as claimed in claim 1, wherein the cross-sectional shape of the roller is a Reureaux polygonal.

4. The biochemical reaction apparatus as claimed in claim 1, wherein the plurality of chambers are equal in length in a direction of the roller movement, and are equal in length to a length of each side of the roller, and an interval between the chambers which are adjacent to one another in the moving direction is an integral multiple of the length of each side of the roller.

5. The biochemical reaction apparatus as claimed in claim 4, wherein a plurality of rollers are provided so as to arrange each roller shaft along a direction perpendicular to the direction of each roller movement, and one roller among the plurality of rollers and one chamber among the plurality of chambers which are pressed by the one roller are equal in length in the direction perpendicular to the moving direction, and are arranged in parallel to one another.

* * * * *